US009920913B2

(12) United States Patent
Heyderman

(10) Patent No.: US 9,920,913 B2
(45) Date of Patent: Mar. 20, 2018

(54) COLOR ASSURANCE LIGHT SYSTEM

(71) Applicant: Richard S. Heyderman, West Orange, NJ (US)

(72) Inventor: Richard S. Heyderman, West Orange, NJ (US)

(73) Assignee: MDR, LLC, West Orange, NJ (US)

( * ) Notice: Subject to any disclaimer, the term of this patent is extended or adjusted under 35 U.S.C. 154(b) by 180 days.

(21) Appl. No.: 15/062,786

(22) Filed: Mar. 7, 2016

(65) Prior Publication Data

US 2016/0258606 A1 Sep. 8, 2016

Related U.S. Application Data

(60) Provisional application No. 62/129,117, filed on Mar. 6, 2015.

(51) Int. Cl.

| | |
|---|---|
| ***F21V 21/14*** | (2006.01) |
| ***F21S 6/00*** | (2006.01) |
| ***F21V 17/00*** | (2006.01) |
| *F21V 21/30* | (2006.01) |
| *F21V 23/04* | (2006.01) |
| *F21Y 115/10* | (2016.01) |
| *F21Y 113/10* | (2016.01) |

(52) U.S. Cl.

CPC ..... *F21V 21/145* (2013.01); *F21S 6/003* (2013.01); *F21V 17/007* (2013.01); *F21V 21/30* (2013.01); *F21V 23/0414* (2013.01); *F21Y 2113/10* (2016.08); *F21Y 2115/10* (2016.08)

(58) Field of Classification Search

CPC ..... F21V 21/145; F21V 21/30; F21V 17/007; F21V 23/0414; F21S 6/003; F21Y 2115/10; F21Y 2113/10; F21W 2131/402

See application file for complete search history.

(56) References Cited

U.S. PATENT DOCUMENTS

| | | | | |
|---|---|---|---|---|
| 4,581,684 A * | 4/1986 | Mazzucco | F21V 17/007 | 362/183 |
| 5,276,597 A * | 1/1994 | Herst | F21S 2/00 | 362/225 |
| D346,457 S * | 4/1994 | Friedman | D26/43 | |
| 6,022,119 A * | 2/2000 | Booty, Jr. | F21V 27/00 | 362/419 |
| 7,490,948 B2 * | 2/2009 | Fisherman | B42D 3/123 | 362/98 |
| 7,517,104 B1 * | 4/2009 | Leen | F21S 8/00 | 362/260 |
| 8,353,609 B2 * | 1/2013 | Chou | F21S 6/003 | 362/162 |
| 8,408,733 B2 * | 4/2013 | Nelson | F16M 11/10 | 362/191 |
| 9,366,420 B2 * | 6/2016 | Kasuga | F21V 23/003 | |

(Continued)

*Primary Examiner* — Joseph L Williams
*Assistant Examiner* — Jose M Diaz
(74) *Attorney, Agent, or Firm* — Stroock & Stroock & Lavan LLP

(57) ABSTRACT

A color assurance device houses an array of distinct LEDs lighting sources with each LED array having a distinct color metric index for simulating a distinct light condition to permit color samples to be viewed under multiple simulated colored lighting conditions. Each color lighting condition is at a temperature range that simulates a well-known lighting condition.

6 Claims, 5 Drawing Sheets

(56) References Cited

U.S. PATENT DOCUMENTS

| | | | | |
|---|---|---|---|---|
| 2006/0067089 | A1* | 3/2006 | Hocquard | A47F 3/001 362/576 |
| 2008/0084693 | A1* | 4/2008 | Shimada | F21S 8/026 362/240 |
| 2009/0019873 | A1* | 1/2009 | Koike | A47F 3/001 62/248 |
| 2009/0303730 | A1* | 12/2009 | Holmberg | F21S 8/00 362/311.01 |
| 2013/0271993 | A1* | 10/2013 | Jan | F21V 21/30 362/249.09 |
| 2014/0251227 | A1* | 9/2014 | Wang | A01K 63/003 119/266 |
| 2017/0009968 | A1* | 1/2017 | Wang | F21V 21/0885 |

* cited by examiner

COLOR ASSURANCE LIGHT SYSTEM

CROSS-REFERENCE TO RELATED APPLICATIONS

This application claims priority under 35 USC, Section 119(e) to Provisional Patent Application No. 62/129,117, filed on Mar. 6, 2015, the entire disclosure of which is incorporated herein by reference.

BACKGROUND OF THE INVENTION

This invention relates generally to a professional color assurance/approval LED lighting system, and in particular to an assembly that creates an overhead lighting source and stable work surface to view color samples, such as paint chips, fabric swatches, floor coverings, etc. Heretofore, light boxes using expensive incandescent, tungsten, and fluorescent bulbs have been used to view color samples under multiple simulated lighting conditions to mitigate the effect of metamerism. However such light boxes are expensive and are not practical for easy use by professionals when color samples are viewed in a retail, architectural, or decorating environment. Specifically, painters, architects, designers, and consumers are challenged by the fact that color samples will appear to be of one shade under one light source and a different shade under a different light source. This phenomenon is known as metamerism. Physical color sample will appear to match under all surfaces if their spectral reflectance curves have a similar shape. Specifically, when the reflectance curves of color samples have different shapes, typically crossing at least three times, these samples are considered a metameric pair. In contrast, two different colors may have the same appearance under one light source (a metameric match) and look different under different light sources (a metameric mismatch). Accordingly, an easily accessed lightweight and portable device having multiple LED light sources that permits a Color Stylists/Advisors (designers, architects, painters) to confirm to buyers/purchaser of color projects a more accurate representation of the color samples under various lighting sources is desired.

SUMMARY OF THE INVENTION

A color assurance device that will confirm color variances in color samples through the use of several specific LED light sources is provided to allow Color Stylists/Advisors (designers, architects, painters) to confirm color variances to the Buyers/Purchaser of Color Projects when color samples of choice are presented to said Buyers/Purchasers of colors.

A housing that includes a hood panel and a floor panel that are pivotally secured to a base to be disposed from a closed position to an open position to create an overhead lighting source and stable work surface to support color swatches/chips for viewing is provided. A plurality LED lights, each having a distinct color metric index for simulating a distinct light condition is disposed in the hood and is controlled by a dedicated switch to permit color samples to be positioned on the floor panel to be viewed under multiple simulated colored lighting conditions. The colors samples will then be seen under a close approximation to how they will appear in real world light and color settings.

Accordingly, it is an object of the invention to provide a lightweight portable foldable device that contains multiple LED light sources to permit color samples, such as paint chips, fabric swatches, etc. to be viewed under a close approximation of how they will appear in real world light and color settings.

It is a further object to provide a simple foldable device that is light weight, folded into a portfolio configuration and uses LED's for allowing color samples to be viewed by consumers and professionals under different simulated lighting conditions.

Other objects and features of this invention will become apparent from the following detailed description, considered in conjunction with the accompanying drawing figures. It is to be understood, however, that the drawings are presented solely for the purpose of illustration and not as a definition of the limits of the invention, for which reference should always be made to the appended claims.

BRIEF DESCRIPTION OF THE FIGURES

Other objectives and advantages of this invention will be more apparent from the following detailed description taken in conjunction with the drawings in which.

DETAIL DESCRIPTION

Figure 1:
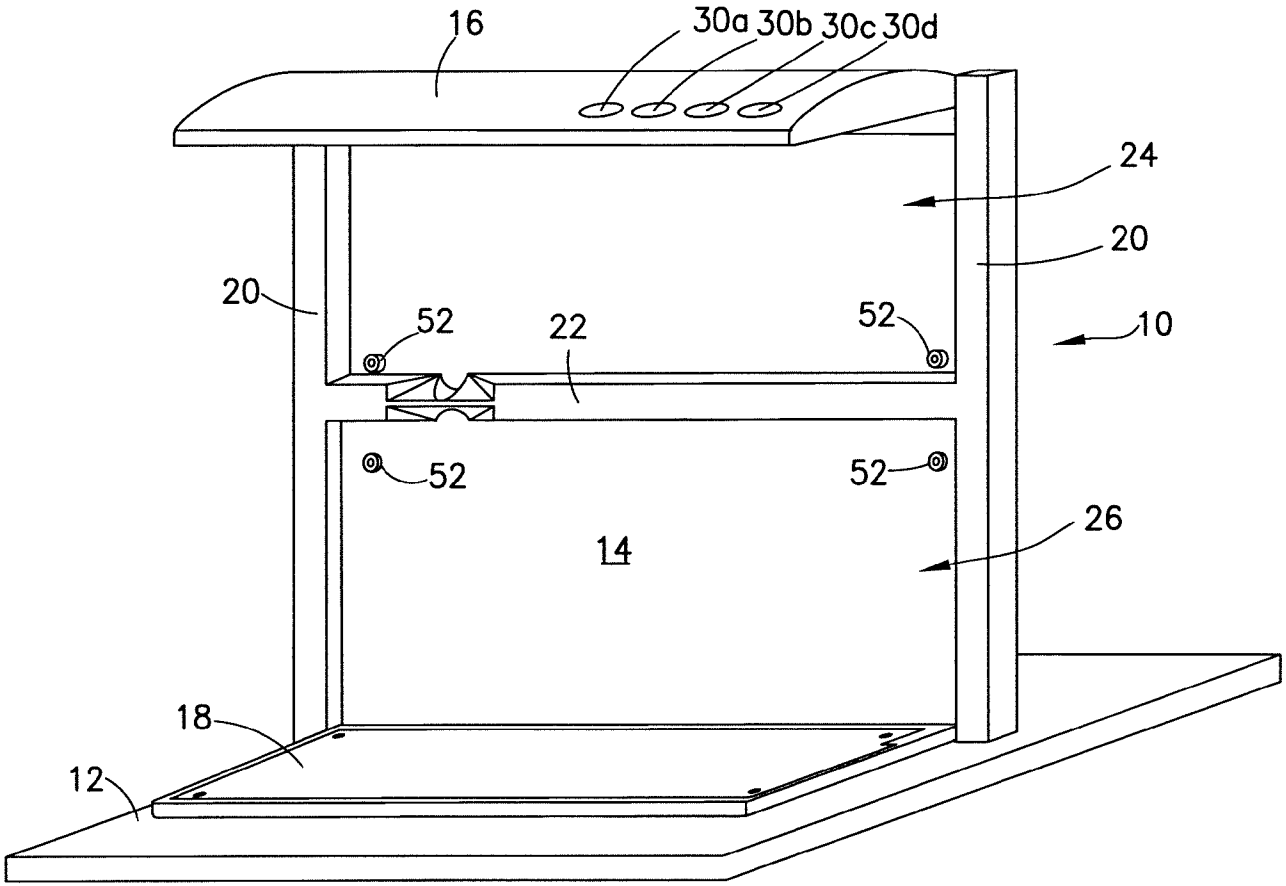
FIG. 1 is a perspective view of the housing assembly of the light system of the instant invention.
Figure 2:
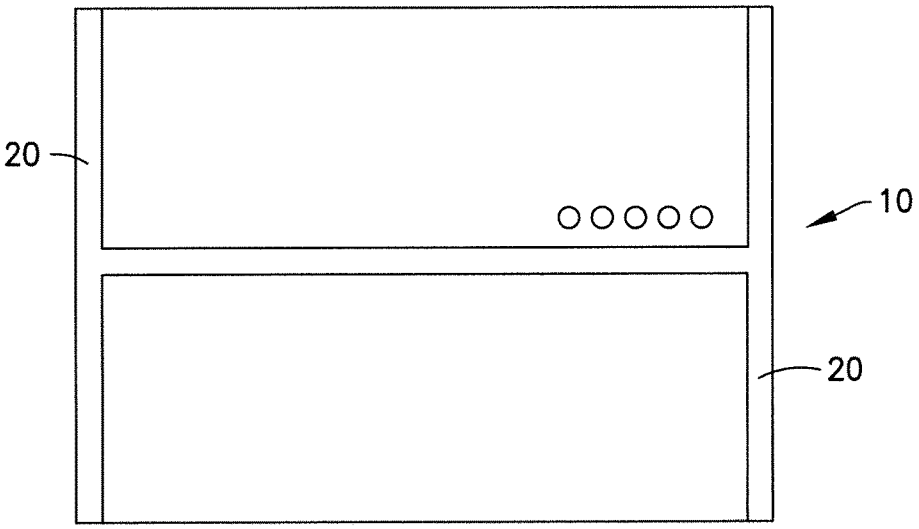
FIG. 2 is a plan view of the housing depicted in FIG. 1 in a closed position.
Figure 3:
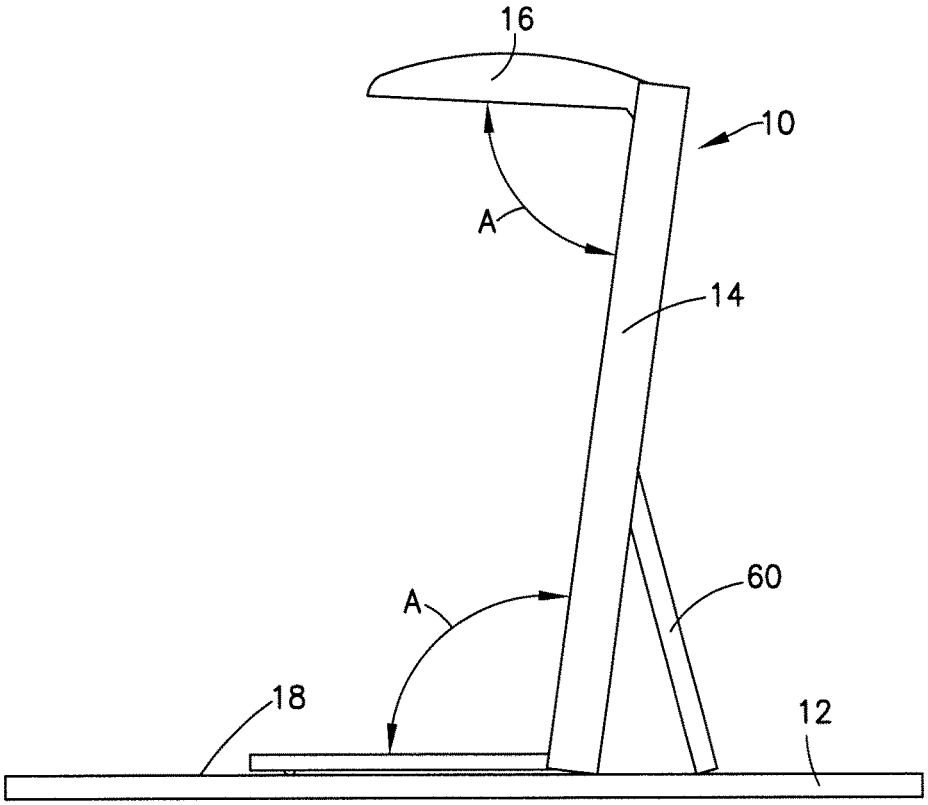
FIG. 3 is a side view of the housing depicted in FIG. 1 in an open position.

Reference is made to FIGS. 1, 2, and 3, wherein the housing for a portable LED light box housing construction in an open position and a closed position, generally, indicated as 10, is shown on a flat surface 12 when disposed in an open position in FIG. 1 and in a closed position, as depicted in FIG. 2. Housing 10 includes a base panel 14, a hood panel 16 and a floor panel 18. As illustrated in FIG. 3, hood panel 16 and floor panel 18 are pivotally secured to base 18 in any suitable manner such as by a ball cup (not shown) so that they can be rotated from an open position as depicted in FIG. 3, in the direction A to a closed position, as depicted in FIG. 2. Panels 16 and 18 are maintained in a substantially horizontal position when fully rotated to the open position as depicted in FIG. 3.

Base panel 14 includes a frame 20 including cross frame member 22 for defining recesses 24 and 26 for receiving hood panel 16 and floor panel 18, respectively. As illustrated in FIG. 2, the housing forms an easily carried portable device that has the feel of a laptop or tablet that can used by professionals, decorators, printers, architects, designers, and the do-it-yourselfers when looking at and selecting the color accuracy of color samples, such as paint chips.

Figure 4:
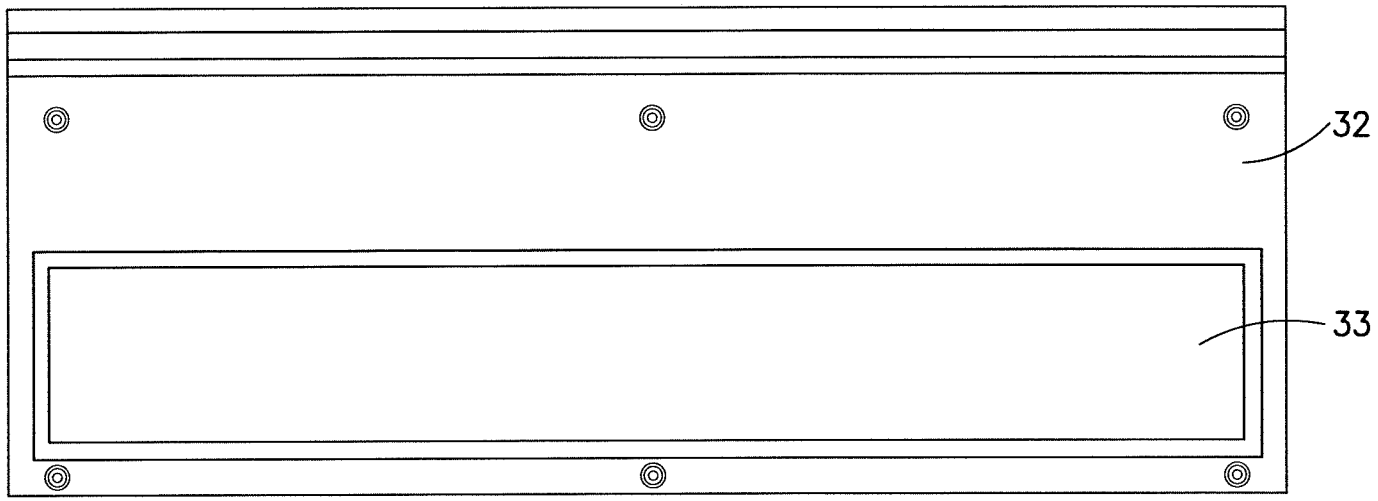
FIG. 4 is top view of the LED lens holder panel of the instant invention.
Figure 5:
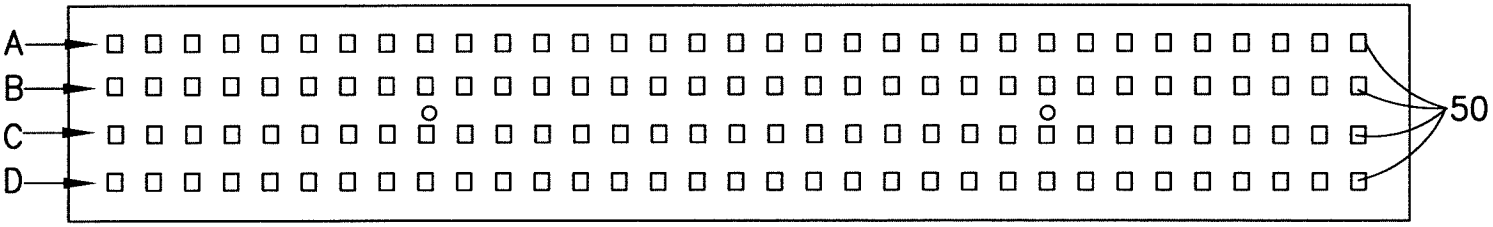
FIG. 5 is a plan view of the array of LEDs that are disposed in the hood panel of the instant invention.
Figure 6:
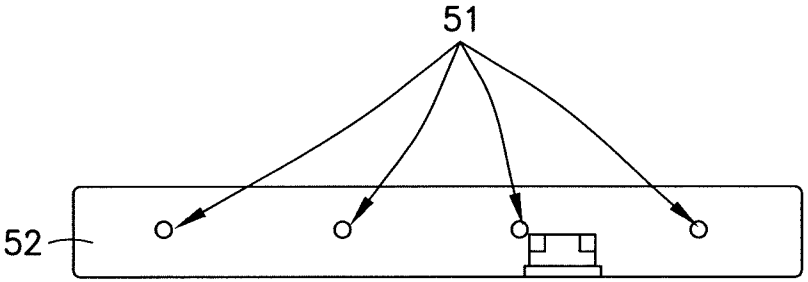
FIG. 6 is perspective view of the 4 button capacitive touch panel disposed in the hood panel of the instant invention.
Figure 7:
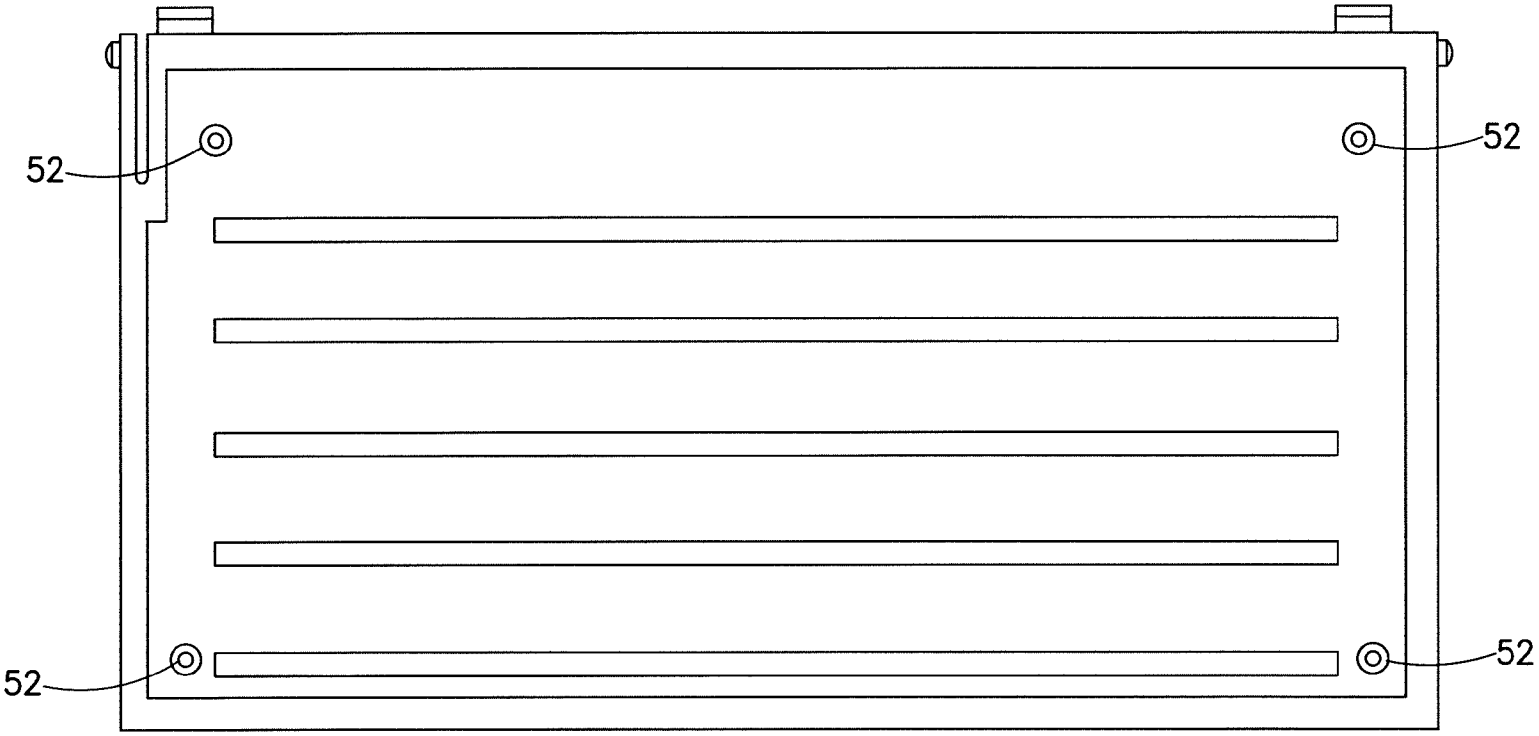
FIG. 7 is front elevation showing view showing the top surface of the lower panel in accordance with the instant invention.

Reference is next made to FIG. 4 wherein an LED lamp lens holder panel 32 having a window b 33 is used to secure an LED light array panel 50 depicted in FIG. 5 by sandwiching the LED light array panel and a standard capacitive touch panel 52, depicted in FIG. 6 between the holder panel and the top of the hood panel. LED array 50 includes 4 rows A, B, C, D which are 3528 SMD LEDs operating at 12V. Each row A, B, C and D emits a different color temperature of light measured in degrees Kelvin, with each temperature being representative of a different lighting condition. In an exemplary embodiment of the invention the programmed LEDs in row A are programmed for a simulated daylight condition that emits light at 6000 to 6500 degrees Kelvin. In row B the LEDs are programmed for a simulated cool white light condition that emits light at 5000 to 5500 degrees Kelvin. In row C, the LEDS are programmed for a simulated compact fluorescent light condition that emits light at 4000 to 4500 degrees Kelvin. In row D, the LEDS would be programmed for a simulated incandescent light condition that emits light at 2800 to 3000 degrees Kelvin.

LED buttons 30*a*, 30*b*, 30*c* and 30*d* are positioned in the hood panel 16 and are respectively connected to LED rows A, B, C and D so that when the hood panel is an open position, the switches are easily accessed from the top of the panel and are used as on/off buttons to activate the various rows of lights.

The bottom panel 18 will rotate to an open position perpendicular to the support surface 12 so that the housing is disposed in standing position. Bottom panel 18 is used to provide a base for placement of a Color Sample such as a paint chip under the LED light sources.

This base has channels/grooves 40 to allow for color samples to sit flat or at predetermined viewing angles for optimum viewing under the different LED rows of lights.

Color samples can consist of color cards/chips, swatches, fabric, carpeting, or any other surface or material containing color/colors.

The back of bottom panel is substantially flat and serves to support and align the LEDs in the hood section and the bottom panel and allow lighting to be directed downward at the color sample that is positioned on the bottom panel when the hood panel and the back panel are rotated to a fully opened position as depicted in FIG. 3.

In a preferred embodiment, the rear of the back section includes a pull out Stand/Leg 60 to allow the entire unit to stand on a flat surface for ease of viewing the color sample. Non Skid pads are used to ensure the entire unit will not slip.

Also, concealed magnets 52 can be disposed on the base panel and for ease of securing both the hood panel and the base bottom panel to the base panel when the panels are disposed in a closed position.

Captive Touch buttons 30*a*, 30*b*, 30*c* and 30*d* are provided with indicator lights so a user knows which buttons are activated. Captive Touch Buttons 30*a*, 30*b*, 30*c* and 30*d* activate corresponding rows of LEDs A, B, C, and D, respectively.

While there have been shown and described fundamental novel features of the invention as applied to the exemplary embodiment thereof, it will be understood that omissions and substitutions and changes in the form and details of the disclosed invention may be made by those skilled in the art without departing from the spirit of the invention. Moreover, as is readily apparent, numerous modifications and changes may readily occur to those skilled in the art. Hence, it is not desired to limit the invention to the exact construction and operation shown and described and accordingly, all suitable modification equivalents may be resorted to falling within the scope of the invention as claimed. It is the intention, therefore, to be limited only as indicated by the scope of the claims appended hereto.

What claim is:

1. A color assurance device comprising:

a base;

a floor panel that is pivotally secured to a base to be disposed from a closed position to an open position; and a hood panel pivotally secured to the base and housing an array of distinct LEDs to create an overhead lighting source for directing light at the floor panel;

each LED having a distinct color metric index for simulating a distinct light condition to permit color samples disposed on the floor panel to be viewed under multiple simulated colored lighting conditions.

2. A color assurance device comprising:

a panel housing an array of distinct LEDs to create a lighting source for directing light at a color sample;

each LED array having a distinct color metric index for simulating a distinct light condition to permit color samples disposed on the floor panel to be viewed under multiple simulated colored lighting conditions; and each color lighting condition being at a temperature range that simulates a particular lighting condition.

3. A color assurance device as claimed in claim 2, wherein at least one array of LEDs is programmed for a simulated daylight condition that emits light at 6000 to 6500 degrees Kelvin.

4. A color assurance device as claimed in claim 2, wherein at least one array of LEDs is programmed for a simulated cool white light condition that emits light at 5000 to 5500 degrees Kelvin.

5. A color assurance device as claimed in claim 2, wherein at least one array of LEDs is programmed for a simulated compact fluorescent light condition that emits light at 4000 to 4500 degrees Kelvin.

6. A color assurance device as claimed in claim 2, wherein at least one array of LEDs is programmed for a simulated incandescent light condition that emits light at 2800 to 3000 degrees Kelvin.

* * * * *